US010858723B2

(12) United States Patent
Cribb et al.

(10) Patent No.: US 10,858,723 B2
(45) Date of Patent: Dec. 8, 2020

(54) COPPER-NICKEL-TIN ALLOY WITH HIGH TOUGHNESS

(71) Applicant: Materion Corporation, Mayfield Heights, OH (US)

(72) Inventors: W. Raymond Cribb, Westerville, OH (US); Chad A. Finkbeiner, Highland Heights, OH (US); Fritz C. Grensing, Perrysburg, OH (US)

(73) Assignee: Materion Corporation, Mayfield Heights, OH (US)

( * ) Notice: Subject to any disclaimer, the term of this patent is extended or adjusted under 35 U.S.C. 154(b) by 0 days.

(21) Appl. No.: 16/257,446

(22) Filed: Jan. 25, 2019

(65) Prior Publication Data

US 2019/0153579 A1 May 23, 2019

Related U.S. Application Data

(62) Division of application No. 14/260,011, filed on Apr. 23, 2014, now Pat. No. 10,190,201.

(60) Provisional application No. 61/815,158, filed on Apr. 23, 2013.

(51) Int. Cl.

| | |
|---|---|
| ***C22F 1/08*** | (2006.01) |
| ***C22C 9/06*** | (2006.01) |
| ***C22C 9/02*** | (2006.01) |

(52) U.S. Cl.

CPC ..... *C22F 1/08* (2013.01); *C22C 9/02* (2013.01); *C22C 9/06* (2013.01)

(58) Field of Classification Search

CPC ..... C22F 1/08; C22C 9/02; C22C 9/06
USPC ..... 148/554
See application file for complete search history.

(56) References Cited

U.S. PATENT DOCUMENTS

| | | | |
|---|---|---|---|
| 3,399,057 | A | 8/1968 | Richardson et al. |
| 4,260,432 | A | 4/1981 | Plewes |
| 4,406,712 | A | 9/1983 | Louzon |
| 5,391,243 | A | 2/1995 | Goto et al. |
| 6,716,292 | B2 | 4/2004 | Nielsen, Jr. et al. |
| 7,879,159 | B2 | 2/2011 | Wright et al. |
| 7,947,133 | B2 | 5/2011 | Mihara et al. |
| 2002/0122722 | A1 | 9/2002 | Bertin |

FOREIGN PATENT DOCUMENTS

| | | | |
|---|---|---|---|
| CN | 101473056 | A | 7/2009 |
| CN | 105143480 | B | 12/2017 |
| EP | 0 833 954 | B1 | 4/2010 |
| JP | 54-057422 | | 5/1979 |
| JP | 56-005942 | | 1/1981 |
| JP | 03-173730 | | 7/1991 |
| JP | 2007297706 | A | 11/2007 |
| JP | 2009-242895 | | 10/2009 |
| SU | 244624 | A1 | 5/1969 |
| WO | WO 9641033 | A1 | 12/1996 |
| WO | WO 2010/114524 | A1 | 10/2010 |

OTHER PUBLICATIONS

ASTM Designation: B 740-02. Standard Specification for Copper-Nickel-Tin Spinoday Alloy Strip. Sep. 2002. [Retrieved on Aug. 5, 2014]. Retrieved from <URL: hyyp://web.askewindustrial.com/ASTM/B740.pdf?tblASTMSpecsPage=34>.

Cribb, et al., "Copper Spinodal Alloys," Advanced Materials and Processes, pp. 1-4, 2002. [Retrieved on Aug. 5, 2014]. Retrieved from <URL:http://www.materion.jp/alloy/tech_lit/Copper%20Spinodal%20Alloys%20Article.pdf>.

Osintsev O,E., Fedorov V.N., Copper and Copper Alloys, Domestic and Foreign Grades, Handbook, Mechanical Engineering, 2004, pp. 194-198, Moscow.

Materion Corporation, ToughMet 3 TSI20U Rod and TS95 Rod, 2013, USA.

Kusner, Robert E. et al., Engineering Guide: ToughMet 3AT (C72900); ToughMet 3CX (C96900), Lamineries Matthey SA, BrushWellman, Feb. 10, 2003, USA.

Cribb, W. Raymond, Copper Spinodal Alloys for Aerospace, Advanced Materials and Processes, Jun. 2006, USA.

Russian Search Report for Russian Application No. 2019101642 dated Feb. 14, 2020.

*Primary Examiner* — Edward M Johnson
(74) *Attorney, Agent, or Firm* — Cozen O'Connor

(57) ABSTRACT

A spinodal copper-nickel-tin alloy with a combination of improved impact strength, yield strength, and ductility is disclosed. The alloy is formed by process treatment steps including solution annealing, cold working and spinodal hardening. These include such processes as a first heat treatment/homogenization step followed by hot working, solution annealing, cold working, and a second heat treatment/spinodally hardening step. The spinodal alloys so produced are useful for applications demanding enhanced strength and ductility such as for pipes and tubes used in the oil and gas industry.

20 Claims, 1 Drawing Sheet

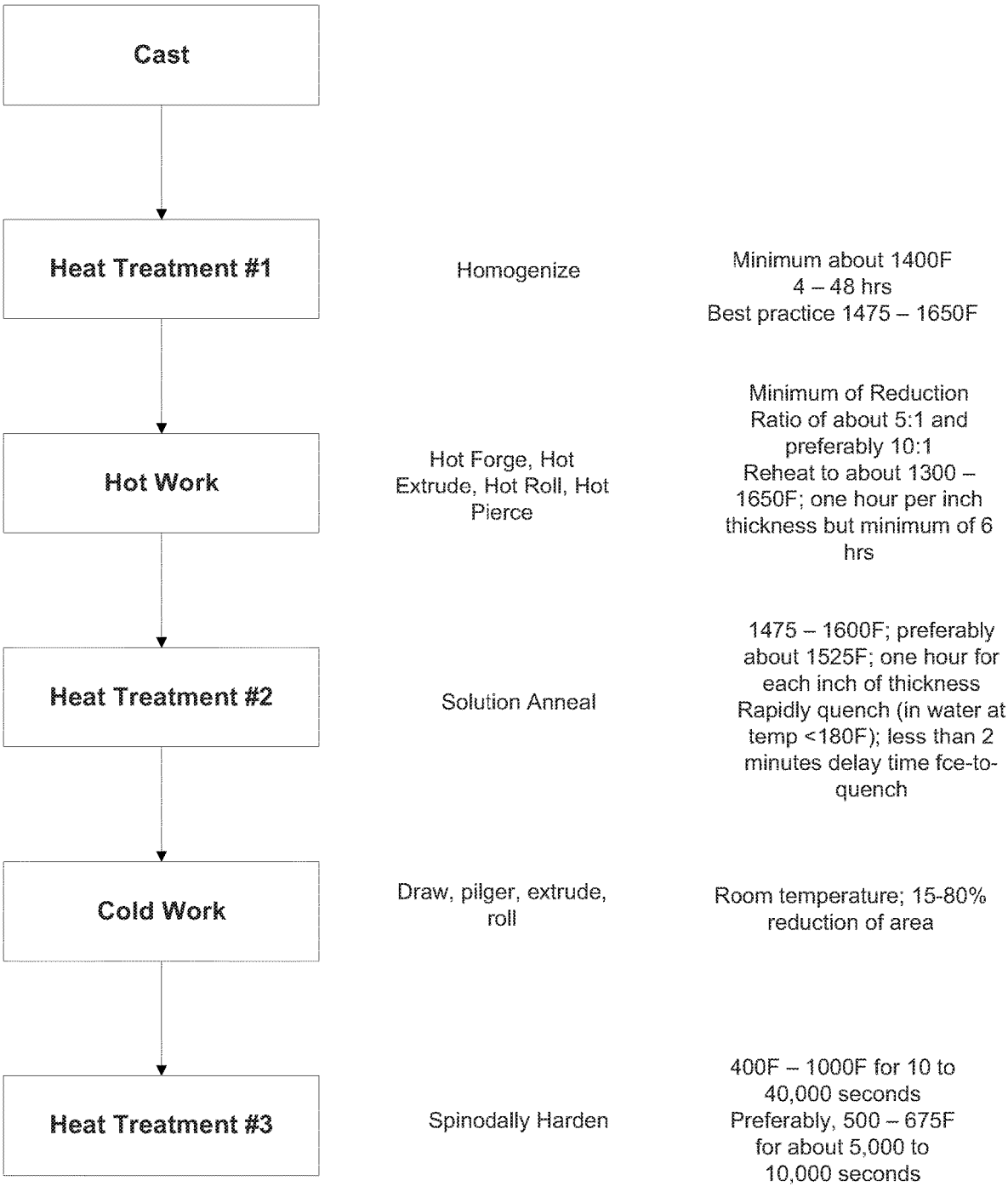
Cast
Heat Treatment #1
Homogenize
Minimum about 1400F
4 – 48 hrs
Best practice 1475 – 1650F
Hot Work
Hot Forge, Hot Extrude, Hot Roll, Hot Pierce
Minimum of Reduction Ratio of about 5:1 and preferably 10:1
Reheat to about 1300 – 1650F; one hour per inch thickness but minimum of 6 hrs
Heat Treatment #2
Solution Anneal
1475 – 1600F; preferably about 1525F; one hour for each inch of thickness
Rapidly quench (in water at temp <180F); less than 2 minutes delay time fce-to-quench
Cold Work
Draw, pilger, extrude, roll
Room temperature; 15-80% reduction of area
Heat Treatment #3
Spinodally Harden
400F – 1000F for 10 to 40,000 seconds
Preferably, 500 – 675F for about 5,000 to 10,000 seconds

COPPER-NICKEL-TIN ALLOY WITH HIGH TOUGHNESS

This application is a divisional of U.S. patent application Ser. No. 14/260,011, filed Apr. 23, 2014, now U.S. Pat. No. 10,190,201, which claims the benefit of U.S. Provisional Application No. 61/815,158 filed Apr. 23, 2013 and is incorporated herein by reference in its entirety.

BACKGROUND

The present disclosure relates to spinodal copper-nickel-tin alloys having a combination of properties, including high impact toughness with high strength and good ductility. Methods for making and using the same are also disclosed herein.

Down hole oil and gas exploration presents a formidable set of requirements due to the drilling environment (corrosion, temperature) and operating conditions (vibrations, impact loading, torsion loading). High strength (>75 ksi YS) copper alloys such as copper-beryllium, aluminum bronzes, and similar precipitation-hardenable alloys possess significantly lower impact characteristics than steel, nickel or other alloys at similar strength levels. Hence, additional materials are needed.

BRIEF DESCRIPTION

The present disclosure relates to spinodal copper-nickel-tin alloys and methods for producing and using such alloys. These alloys have surprisingly high levels of impact toughness, and strength, along with good ductility, among other properties. These are characteristics of key importance for producing tubes, pipes, rods and other symmetrical shaped products used in applications for oil and gas drilling/exploration, as well as for use in other industries.

These and other non-limiting characteristics of the disclosure are more particularly disclosed below.

BRIEF DESCRIPTION OF THE DRAWINGS

The following is a brief description of the drawings, which are presented for the purposes of illustrating the exemplary embodiments disclosed herein and not for the purposes of limiting the same.

FIG. 1 The FIGURE is a diagram of the treatment process used in the present disclosure.

DETAILED DESCRIPTION

The present disclosure may be understood more readily by reference to the following detailed description of desired embodiments and the examples included therein. In the following specification and the claims which follow, reference will be made to a number of terms which shall be defined to have the following meanings.

The singular forms "a," "an," and "the" include plural referents unless the context clearly dictates otherwise.

As used in the specification and in the claims, the term "comprising" may include the embodiments "consisting of" and "consisting essentially of."

Numerical values should be understood to include numerical values which are the same when reduced to the same number of significant FIGURES and numerical values which differ from the stated value by less than the experimental error of conventional measurement technique of the type described in the present application to determine the value.

All ranges disclosed herein are inclusive of the recited endpoint and independently combinable (for example, the range of "from 2 grams to 10 grams" is inclusive of the endpoints, 2 grams and 10 grams, and all the intermediate values).

As used herein, approximating language may be applied to modify any quantitative representation that may vary without resulting in a change in the basic function to which it is related. Accordingly, a value modified by a term or terms, such as "about" and "substantially," may not be limited to the precise value specified, in some cases. The modifier "about" should also be considered as disclosing the range defined by the absolute values of the two endpoints. For example, the expression "from about 2 to about 4" also discloses the range "from 2 to 4."

The term "room temperature" refers to a range of from 20° C. to 25° C.

The spinodal copper-nickel-tin alloys of the present disclosure have high impact toughness that are comparable to or exceed that of steel, nickel alloys, titanium alloys, and other copper alloys, along with good strength and ductility. As utilized herein, high impact strength is associated, in part, with high notch failure resistance. Consequently, the present alloys have high notch strength ratios.

The spinodal copper-nickel-tin (CuNiSn) alloys disclosed herein comprise from about 5 wt % to about 20 wt % nickel, from about 5 wt % to about 10 wt % tin, and the remainder copper. More preferably, the copper-nickel-tin alloys comprise from about 14 wt % to about 16 wt % nickel, including about 15 wt % nickel; and from about 7 wt % to about 9 wt % tin, including about 8 wt % tin; and the balance copper, excluding impurities and minor additions. The alloys, after the processing steps described herein, have a 0.2% offset yield strength of at least 75,000 psi (i.e., 75 ksi). The alloys also have an impact toughness of at least 30 foot-pounds when measured according to ASTM E23, using a V notch at room temperature.

The unusual combination of high strength and impact toughness and good ductility produced by the present alloys is obtained by treatment processes that include at least the steps of solution annealing, cold working and spinodal hardening. For example, in one non-limiting embodiment, the process includes the overall steps of vertical continuous casting, homogenization, hot working, solution annealing, cold working, and a spinodal hardening treatment. It is contemplated that the resulting alloy produced by these processes can be used to make fluid transmission tubes and/or pipes having a diameter of up to at least 10 inches such as those used in the oil and gas industries, as well as other symmetrical shapes including rods, bars and plates. These alloys exploit the balance between grain boundary and bulk grain fracture.

In this regard, the copper-nickel-tin spinodal alloys disclosed herein generally comprise from about 5 wt % to about 20 wt % nickel, from about 5 wt % to about 10 wt % tin, and a remainder copper, excluding impurities and minor additions. Minor additions include boron, zirconium, iron, and niobium, which further enhance the formation of equiaxed crystals and also diminish the dissimilarity of the diffusion rates of Ni and Sn in the matrix during solution heat treatment. Another minor addition includes magnesium which deoxidizes the alloy when the alloy is in the molten state. It has also been discovered that the addition of manganese significantly improves the ultimate properties developed whether or not sulfur is present in the alloy as an impurity. Other elements may also be present. Not more than about 0.3% by weight of each of the foregoing elements is present in the copper-nickel-tin alloys.

Briefly, in one embodiment noted above, the methods of preparing the spinodal copper-nickel-tin alloys comprise continuously vertically casting the alloy to form a casting or cast alloy; homogenizing the cast alloy (i.e. a first heat treatment); hot working the homogenized alloy; solution annealing the hot worked alloy (i.e. a second heat treatment); cold working the solution annealed alloy; and spinodally hardening the material after the cold working (i.e. a third heat treatment) to obtain the alloy. In this regard, it should be noted that the term "alloy" refers to the material itself, while the term "casting" refers to the structure or product made of the alloy. The terms "alloy" and "casting" may be used interchangeably in the disclosure. The process is also illustrated in the FIGURE.

Initially, the processing of the copper-nickel-tin alloy begins by casting the alloy to form a casting having a fine and largely unitary grain structure such as by continuously vertically casting. Depending on the desired application, the casting can be a billet, bloom, slab, or a blank, and in some embodiments has a cylindrical or other shape. Continuous casting processes and apparatuses are known in the art. See for example U.S. Pat. No. 6,716,292, fully incorporated herein by reference.

Next, the casting is subjected to a first heat treatment or homogenization step. The heat treatment is performed at a temperature in excess of 70 percent of the solidus temperature for a sufficient length of time to transform the matrix of the alloy to a single phase (or very nearly to a single phase). In other words, the alloy is heat treated to homogenize the alloy. Depending upon the final mechanical properties desired, the temperature and the period of time to which the casting is heat treated can be varied. In embodiments, the heat treatment is performed at a temperature of about 1400° F. or higher, including a range of from about 1475° F. to about 1650° F. The homogenization may occur for a time period of from about 4 hours to about 48 hours.

Next, the homogenized alloy or casting is subjected to hot working. Here, the casting is subjected to significant uniform mechanical deformation that reduces the area of the casting. The hot working can occur between the solvus and the solidus temperatures, permitting the alloy to recrystallize during deformation. This changes the microstructure of the alloy to form finer grains that can increase the strength, ductility, and toughness of the material. The hot working may result in the alloy having anisotropic properties. The hot working can be performed by hot forging, hot extrusion, hot rolling, or hot piercing (i.e. rotary piercing) or other hot working processes. The reduction ratio should be a minimum of about 5:1, and preferably is at least 10:1. During the hot working, the casting may be reheated to a temperature of about 1300° F. to about 1650° F. The reheating should be performed for about one hour per inch thickness of the casting, but in any event for at least 6 hours.

A second heat treatment process is then performed on the hot-worked casting. This second heat treatment acts as a solution annealing treatment. The solution annealing occurs at a temperature of from about 1470° F. to about 1650° F., and for a time period of from 0.5 hours to about 6 hours.

Generally, an immediate cold water quench of the alloy is carried out after the solution annealing treatment. The water temperature used for the quench is at 180° F. or less. Quenching provides a means of preserving as much of the structure obtained from the solution annealing treatment. Minimizing the time interval from removal of the casting from the heat treating furnace until the start of the quench is important. For example, any delay greater than 2 minutes between removal of the alloy from the solution heat treatment furnace and quench is deleterious. The alloy should be held in the quench for at least thirty (30) minutes. Air or controlled atmosphere cooling may also be acceptable as a substitute for the quenching.

In general, if a comparison is made of the properties of an alloy aged for equivalent times, but at different temperatures, more ductility and less strength or hardness is obtained at the lesser of the two temperatures. The same thermodynamic principle applies to an alloy aged at equivalent temperatures but at different times.

Next, the solution annealed material is cold worked, or put another way cold working or wrought processing is performed upon the solution annealed material. The alloy is usually "soft" and easier to machine or form after the heat treatment. Cold working is the process of altering the shape or size of the metal by plastic deformation and can include rolling, drawing, pilgering, pressing, spinning, extruding, or heading of the metal or alloy. Cold working is generally performed at a temperature below the recrystallization point of the alloy and is usually done at room temperature. Cold working increases the hardness and tensile strength of the resultant alloy while generally reducing the ductility and impact characteristics of the alloy. Cold working also improves the surface finish of the alloy. The process is categorized herein as a percentage of plastic deformation. This reduces microsegregation by mechanically reducing secondary inter-dendritic distances. Cold working also increases the yield strength of the alloy. The cold working is generally done at room temperature. A 15%-80% reduction in area should have occurred after the cold working. After cold working has been completed it can be repeated within the same parameters by repeating the solution anneal until the desired size or other parameters are produced. Cold working must directly precede spinodal hardening.

The cold worked alloy or casting is then subjected to a third heat treatment. This heat treatment acts to spinodally harden the casting. Generally speaking, the spinodal hardening occurs at a temperature within the spinodal region, which is in embodiments between about 400° F. and about 1000° F., including from about 450° F. to about 725° F. and from about 500° F. to about 675° F. This causes a short range diffusion to occur that produces chemically different zones with an identical crystal structure to the general matrix. The structure in the spinodally hardened alloy is very fine, invisible to the eye, and continuous throughout the grains and up to the grain boundaries. Alloys strengthened by spinodal decomposition develop a characteristic modulated microstructure. Resolution of this fine scale structure is beyond the range of optical microscopy. It is only resolved by skillful electron microscopy. Alternatively, the satellite reflections around the fundamental Bragg reflections in the electron diffraction patterns have been observed to confirm spinodal decomposition occurring in copper-nickel-tin and other alloy systems. The temperature and the period of time to which the casting is heat treated can be varied to obtain the desired final properties. In embodiments, this third heat treatment is performed for a time period of from about 10 seconds to about 40,000 seconds (about 11 hours), including from about 5,000 seconds (about 1.4 hours) to about 10,000 seconds (about 2.8 hours) and from about 0.5 hours to about 8 hours.

In some particular embodiments, the solution annealing occurs at a temperature of from about 1475° F. to about 1650° F. and for a time of from about 0.5 hours to about 6 hours; the cold working results in a reduction of area in the hot-worked material from about 15% to about 80%; and the spinodal hardening occurs at a temperature of from about 500° F. to about 675° F. and for a time of from about 0.5 hours to about 8 hours.

Utilizing the above described process, a surprising combination of high impact strength and high ductility is obtained. The alloy has a 0.2% offset yield strength greater than 75,000 psi (i.e. 75 ksi). In some particular embodiments, the 0.2% offset yield strength is from about 95 ksi to about 120 ksi. It is possible that the yield strength may be in excess of 200 ksi. The alloy may also have high ductility, i.e. greater than 65% or 75% reduction of area when measured at room temperature. The alloy can have a minimum elongation of 20%. The alloy will also have an impact toughness of at least 12 foot-pounds (ft-lbs), as measured according to ASTM E23 with a V-notch and at room temperature, including a range from at least 30 ft-lbs up to about 100 ft-lbs.

In some particular embodiments, the alloy has a 0.2% offset yield strength of at least 110 ksi, an impact toughness of at least 12 foot-pounds, and an ultimate tensile strength of at least 120 ksi.

In other particular embodiments, the alloy has a 0.2% offset yield strength of at least 95 ksi, an impact toughness of at least 30 foot-pounds, and an ultimate tensile strength of at least 105 ksi.

Without being bound by theory, it is believed that the yield strength of the copper-nickel-tin alloy can be attributed to several mechanisms. First, the tin and the nickel together contribute a fixed amount of strength of approximately 25 ksi. The copper adds about 10 ksi in strength as well. The cold working adds from 0 to about 80 ksi of strength. The spinodal hardening can add from 0 to about 90 ksi of strength. It appears that for a given target strength, about 20% of the strengthening should be created by the spinodal transformation (i.e. heat) and about 80% should be created by the cold working. Reversing these proportions is not effective and in fact can be deleterious. However, by balancing the amount of cold working and spinodal hardening, specific target strength levels can be achieved.

Example property combinations achievable with different amounts of cold working and heat treatment to achieve about 95 ksi yield strength in Cu-15Ni-8Sn alloy after solution annealing a wrought product. Nominal diameter is 1 inch.

| Condition | 0.2% Offset Yield Strength | Ultimate Tensile Strength | Elongation, % | Impact Toughness, ft-lb (CVN test) | Comment |
|---|---|---|---|---|---|
| As-Solution-Annealed (SA) | 35 | 80 | 50 | >100 | Base material |
| SA + cold work (CW)30% | 65 | 75 | 30 | 85 | Effect of CW |
| SA + CW30% + spinodal hardening | 103 | 116 | 27 | 45-50 | After heat treatment to achieve high fracture resistance (CVN) |
| SA + spinodal hardening | 110 | 125 | 15 | 4-7 | Without balancing with cold work |

Among other applications, the spinodal copper-nickel-tin alloys disclosed herein are particularly useful in the oil and gas exploration industry for forming tubes, pipes, rods, bars and plates. By virtue of processing, including vertical continuous casting, homogenization, various specific heat treatments before and after cold working, and unusual combination of strength in excess of 95,000 psi, 0.2% offset yield strength with impact toughness to about 100 foot-pounds is now possible. These are characteristics of key importance to the oil and gas drilling market. Moreover, while several process steps were noted above, in order to achieve optimum combination of strength, ductility and toughness, at least three process steps are critical, i.e., solution annealing, cold working and spinodal hardening. These steps are represented by the bottom three process steps shown in the FIGURE.

The present disclosure has been described with reference to exemplary embodiments. Obviously, modifications and alterations will occur to others upon reading and understanding the preceding detailed description. It is intended that the present disclosure be construed as including all such modifications and alterations insofar as they come within the scope of the appended claims or the equivalents thereof.

The invention claimed is:

1. A spinodal copper-nickel-tin alloy having a 0.2% offset yield strength of at least 110 ksi, an impact toughness of at least 12 foot-pounds when measured according to ASTM E23, V notch at room temperature, and an ultimate tensile strength of at least 120 ksi, and a minimum elongation of 20%.

2. The spinodal copper-nickel-tin alloy of claim 1, wherein the alloy comprises from about 5 wt % to about 20 wt % nickel, from about 5 wt % to about 10 wt % tin, and the remainder copper.

3. The spinodal copper-nickel-tin alloy of claim 1, wherein the alloy comprises from about 14 wt % to about 16 wt % nickel, from about 7 wt % to about 9 wt % tin, and the remainder copper.

4. The spinodal copper-nickel-tin alloy of claim 1, having an impact toughness of at least 30 foot-pounds and up to about 100 foot-pounds, when measured according to ASTM E23, V notch at room temperature.

5. The spinodal copper-nickel-tin alloy of claim 1, having a magnetic permeability of less than 1.02.

6. The spinodal copper-nickel-tin alloy of claim 1, further comprising a minor addition of not more than about 0.3 wt % of at least one element selected from the group consisting of zirconium, iron, and magnesium.

7. A spinodal copper-nickel-tin alloy produced by a process comprising:

casting a copper-nickel-tin alloy;

homogenizing the alloy;

hot working the homogenized alloy to obtain a reduction ratio which is a minimum of about 5:1;

solution annealing the hot worked alloy at a temperature of from about 1470° F. to about 1650° F.;

cold working the solution annealed alloy until a reduction of area of from about 15% to about 80% occurs in the alloy; and spinodally hardening the alloy after the cold working to produce the spinodal alloy;

wherein the spinodal alloy has a 0.2% offset yield strength of at least 110 ksi, an impact toughness of at least 12 foot-pounds when measured according to ASTM E23, V notch at room temperature, and an ultimate tensile strength of at least 120 ksi, and a minimum elongation of 20%.

8. The method of claim 7, wherein the copper-nickel-tin alloy comprises from about 14 wt % to about 16 wt % nickel, from about 7 wt % to about 9 wt % tin, and the balance copper.

9. The method of claim 7, wherein the homogenizing occurs at a temperature of about 1400° F. or higher, or at a temperature from about 1475° F. to about 1650° F.

10. The method of claim 7, wherein the homogenizing occurs for a time of from about 4 hours to about 48 hours.

11. The method of claim 7, wherein the hot working occurs at a temperature of from about 1300° F. to about 1650° F.

12. The method of claim 7, wherein the reheat for hot working occurs for a time of at least 6 hours.

13. The method of claim 7, wherein the solution annealing occurs for a time of from about 0.5 hours to about 6 hours.

14. The method of claim 7, further comprising a quenching after the solution annealing.

15. The method of claim 14, wherein the quenching occurs within 2 minutes of completion of the solution annealing.

16. The method of claim 7, wherein the cold working occurs at room temperature.

17. The method of claim 7, wherein the steps of cold working or solution annealing are repeated until a desired size is obtained.

18. The method of claim 7, wherein the spinodal hardening occurs at a temperature of from about 400° F. to about 1000° F., or at a temperature of from about 450° F. to about 725° F., or at a temperature of from about 500° F. to about 675° F.

19. The method of claim 7, wherein the spinodal hardening occurs for a time of from about 10 seconds to about 40,000 seconds, for a time of from about 5,000 seconds to about 10,000 seconds, or for a time of from about 0.5 hours to about 8 hours.

20. A spinodal copper-nickel-tin alloy produced by a method comprising:

solution annealing a copper-nickel-tin alloy wherein the solution annealing occurs at a temperature of from about 1475° F. to about 1650° F. and for a time of from about 0.5 hours to about 6 hours;

cold working the solution annealed alloy, wherein the cold working results in a reduction of area in the alloy of from about 15% to about 80%; and spinodally hardening the alloy after cold working, wherein the spinodal hardening occurs at a temperature of from about 500° F. to about 675° F. and for a time of from about 0.5 hours to about 8 hours.

* * * * *